US006596953B2

(12) United States Patent
Chu

(10) Patent No.: US 6,596,953 B2
(45) Date of Patent: Jul. 22, 2003

(54) KEY SWITCH THAT ENHANCES AIR FLOW BENEATH THE SWITCH

(75) Inventor: Shao-Kang Chu, Hsi-Chih (TW)

(73) Assignee: Aopen Inc., Hsi-Chih (TW)

( * ) Notice: Subject to any disclaimer, the term of this patent is extended or adjusted under 35 U.S.C. 154(b) by 0 days.

(21) Appl. No.: 10/063,082

(22) Filed: Mar. 17, 2002

(65) Prior Publication Data

US 2003/0089588 A1 May 15, 2003

(30) Foreign Application Priority Data

Nov. 15, 2001 (TW) ..... 90128378 A

(51) Int. Cl.[7] ..... H01H 3/12
(52) U.S. Cl. ..... 200/341; 200/5 A
(58) Field of Search ..... 200/341, 289, 200/575, 306, 344, 345, 5 A; 400/490, 491.1, 491.2, 491, 495, 495.1, 496

(56) References Cited

U.S. PATENT DOCUMENTS 5,626,222 A * 5/1997 Aguilera ..... 200/305

FOREIGN PATENT DOCUMENTS

JP 5250959 * 9/1993

* cited by examiner

*Primary Examiner*—Elvin Enad
*Assistant Examiner*—Lisa Klaus
(74) *Attorney, Agent, or Firm*—Winston Hsu

(57) ABSTRACT

A key switch includes a keycap, an upper cover, a lower cover, a connecting device and a heat dissipating device. The upper cover is disposed under the keycap. The lower cover is disposed under the upper cover. The connecting device is connected between the keycap and the upper cover for moveably connecting the keycap above the upper cover. The heat dissipating device includes a container and a piston. A sidewall of the container includes at least a first opening and at least a second opening formed between the upper cover and the lower cover for dissipating heat between the upper cover and the lower cover.

7 Claims, 10 Drawing Sheets

KEY SWITCH THAT ENHANCES AIR FLOW BENEATH THE SWITCH

BACKGROUND OF INVENTION

1. Field of the Invention

The present invention relates to a key switch, and more particularly, to a key switch with a keycap moving in an up and down manner to enhance air flow beneath the key switch.

2. Description of the Prior Art

With the development of very large scale integration (VLSI) complexity, the transistor's operating frequency is increasing rapidly, causing high power consumption and a great amount of heat. The high temperature destroys the electrical device easily. In order to prolong life of the electrical device, heat dissipation is an important topic for researching. Because a portable computer is small and thin, ther heat generated by the electrical devices does not expel easily, therefore the heat dissipation is very important.

The heat dissipation method of an electrical device normally includes active and passive cooling methods. Active cooling utilizes a fan to take hot air away, but the operation of the fan for a long time consumes a large amount of electrical energy and makes noise. Passive cooling deceases the heat generated from the electrical device by redyucing the system efficiency. Neither of the two methods is good enough to dissipate the heat generated from the electrical decice.

Please refer to FIG. 1. FIG. 1 is a schematic diagram of a prior art personal computer 10 using another conventional heat dissipating method. The personal computer 10 incudes a housing 12, a keyboard 14, a processor 16, a chipset 18, and a heat conductive tube 20. The keyboard 14 covers a large part of the housing 12. The processor 16 and the chipset 18, are disposed under the keyboard 14, and generate a large amount of heat while operating. The heat conductive tube 20 is located under the the processor 16 and the chipset 18 for conducing the heat generated from the processor 16 and the chipset 18. Because the keyboard 14 occupies a great part of the housing 12, it is usually used for heat dissipation. The temperature of the area surrounding the procesor 16 and the chipset 18 is higher than the area far away them. Because the heat conductive tube 20 is made of metal and has a great conductivity, the heat can be conducted from the area with higher temperature to the area with lower temperatrue quickly for dissipating the heat. The heat conductive tube 20 can also use other heat dissipating devices that conduct the heat quickly, such as a metal heat sink. However, the efficiency of this method is not ideal for taking away the large amount of heat generated by the electrical decices, such as the processor 16 and the chipsety 18, and the active cooling is usually needed to dissipate the heat.

SUMMARY OF INVENTION

It is therefore a primary objective of the claimed invention to provide a key switch with a keycap moving in an up and down manner to enhance air flow beneath the key switch.

According to the claimed invention, a key switch of a computer keyboard comprises a keycap, an upper cover placed under the keycap, a lower cover placed under the upper cover, a connecting device connected between the keycap and the upper cover for moveably connecting the keycap above the upper cover in an up and down manner, and a heat dissipating device comprising a container and a piston. The top of the piston is fixed on the bottom of the keycap, the bottom of the piston is movably installed inside an opening formed on the top of the container, the bottom of the container is fixed on the lower cover, and a sidewall of the container comprises at least a first opening and at least a second opening formed between the upper cover and the lower cover for dissipating heat between the upper cover and the lower cover. When the keycap is depressed, the piston moves downward with the keycap so as to expel air inside the container through the first opening. When the keycap is released, the piston moves upward with the keycap allowing air outside the container to enter the container through the second opening.

It is an advantage of the claimed invention to use the key switch to move the air from a higher temperature area to a lower temperature area, dissipating heat without and requiring more power.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
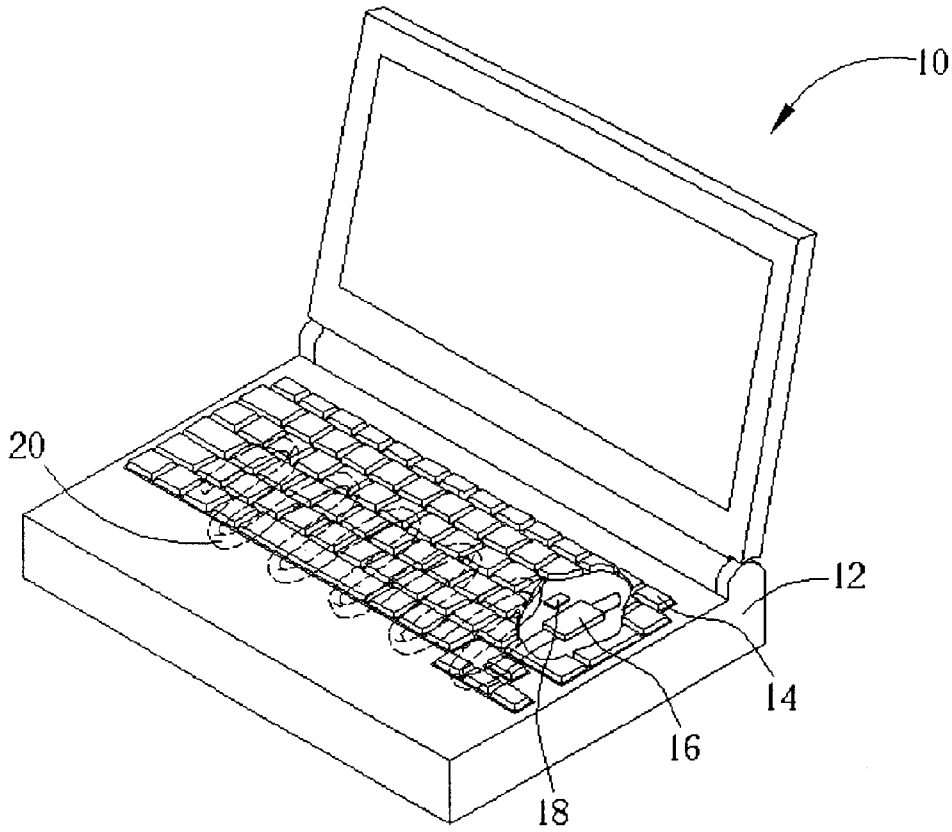
Fig. 1 Prior art
FIG. 1 is a schematic diagram of a prior art personal computer.
Figure 2:
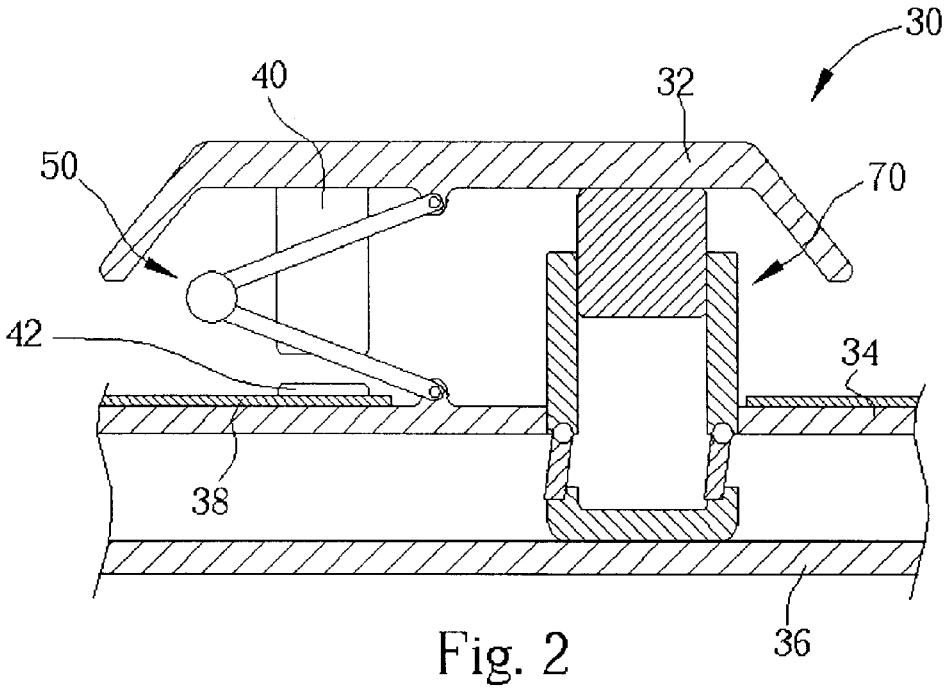
FIG. 2 is a side view illustrating a key switch according to the present invention.

Please refer to FIG. 2. FIG. 2 is a side view illustrating a key switch 30 according to the present invention. The key switch 30 includes a keycap 32, an upper cover 34 located under the keycap 32, a lower cover 36 located under the upper cover 34, a connecting device 50 connected between the keycap 32 and the upper cover 34 for moveably connecting the keycap 32 to the upper cover 34 in an up and down manner, and a heat dissipating device 70 located between the keycap 32 and the lower cover 36 for dissipating heat between the upper cover 34 and the lower cover 36. An elastic component 40, which can be compressed to deform, is located on the bottom of the keycap 32. A flexible printed circuit board (FPCB) 38 having a pressure sensor 42 installed thereon is located on the upper cover 34. When the keycap 32 is depressed, the elastic component 40 depresses the pressure sensor 42 to generate corresponding key signals.

Figure 3:
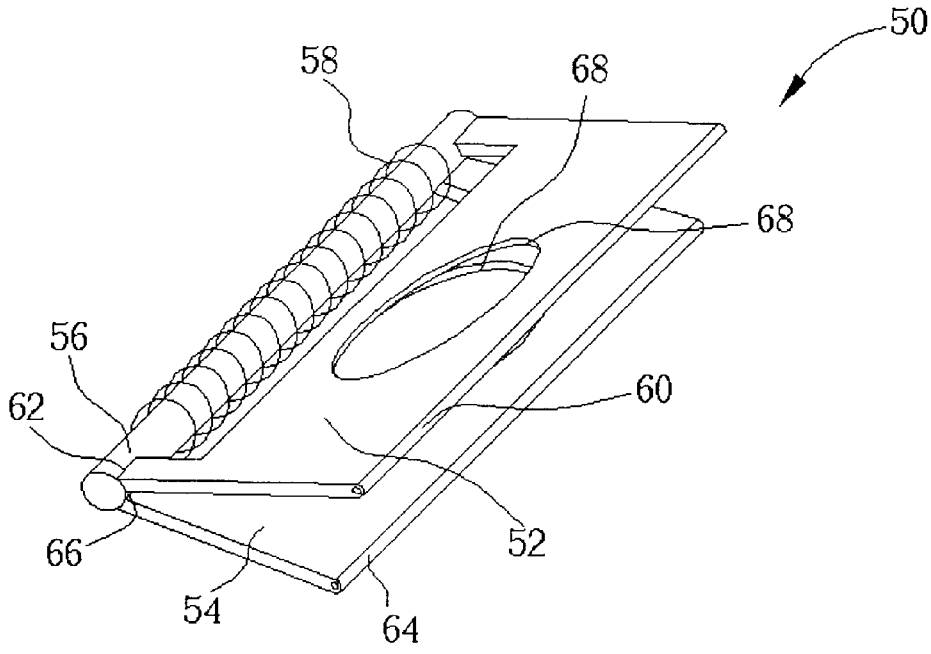
FIG. 3 is a schematic diagram of a connecting device of the key switch shown in FIG. 2.

Please to FIG. 3. FIG. 3 is a schematic diagram of the connecting device 50 shown in FIG. 2. The connecting device 50 includes a first rotational arm 52, a second rotational arm 54, and a shaft 56. The first rotational arm 52 includes a first edge 60 hinged pivotally to the bottom of the keycap 32, and a second edge 62 hinged pivotally to the shaft 56. The second rotational arm 54 includes a first edge 64 hinged pivotally to the top of the upper cover 34, and a second edge 66 hinged pivotally to the shaft 56. An opening 68 is formed in the center of the first rotational arm 52 and the second rotational arm 54, allowing the elastic component 40 to penetrate the opening 68. A spring 58 is installed on the shaft 56 for elastically spreading the first rotational arm 52 and the second rotational arm 54 to keep the first rotational arm 52 and the second rotational arm 54 in their original positions. Due to the first edge 60 of the first rotational arm 52 is fixed on the bottom of the keycap 32, to keep the keycap 32 at its original up position. When the keycap 32 is depressed, the second edge 62 of the first rotational arm 52 and the second edge 66 of the second rotational arm 54 rotate to deform the spring 58. When the keycap 32 is released, the spring 58 returns to its original shape driving the first rotational arm 52 and the second rotational arm 54 back to the original positions, and the first edge 60 of the first rotational arm 52 pushes the keycap 32 upward to the original position simultaneously.

Figure 4:
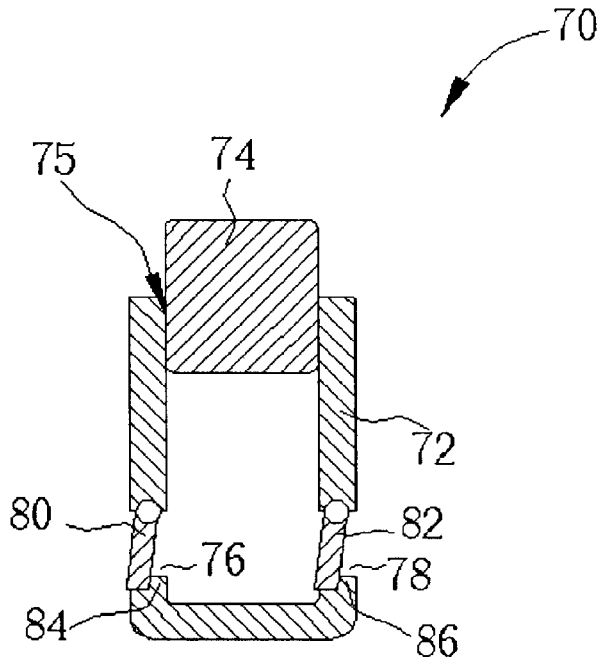
FIG. 4 is a schematic diagram of a heat-dissipating device of the key switch in FIG. 2.

Please refer to FIG. 4. FIG. 4 is a schematic diagram of the heat dissipating device 70 shown in FIG. 2. The heat dissipating device 70 includes a container 72 and a piston 74. A bottom of the container 72 is fixed on the lower cover 36, and an opening 75 is formed on a top of the container 72. A top of the piston 74 is fixed on a bottom of the keycap 32, and the piston 74 is movably installed inside the opening 75 in an up and down manner. In addition, a sidewall of the container 72 includes a first opening 76, a first door 80, a second opening 78, and a second door 82 formed between the upper cover 34 and the lower cover 36. An upper side of the first door 80 is hinged pivotally to an upper side of the first opening 76, and a bump 84 is located at a lower right side of the first opening 76, so that the first door 80 opens toward an outside direction of the container 72 only. Similarly, an upper side of the second door 82 is hinged pivotally to an upper side of the second opening 78, and a bump 86 is located at a lower right side of the second opening 78, so that the second door 82 opens toward an inside direction of the container 72 only.

Figure 5A:
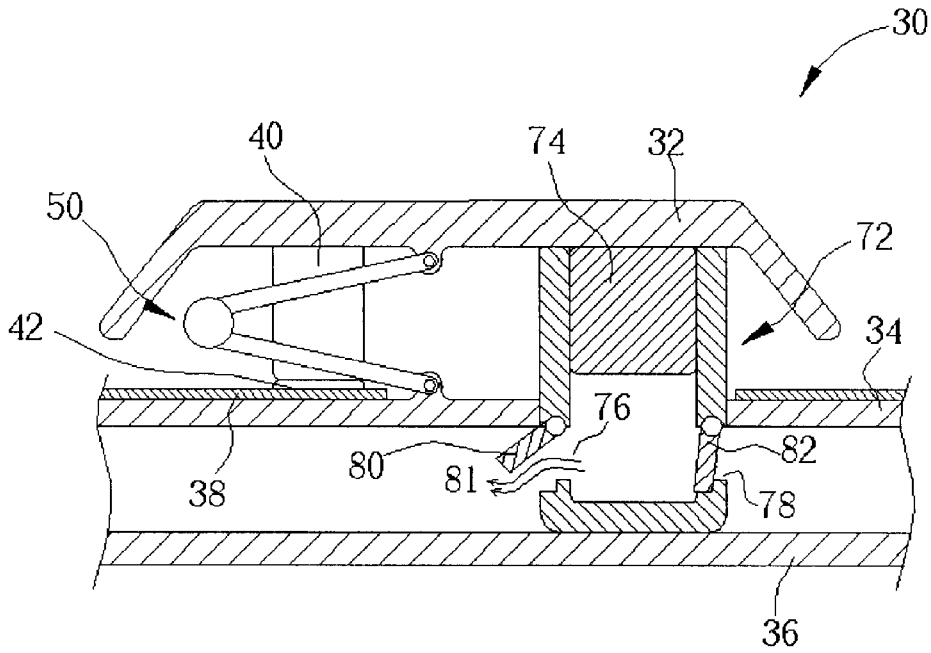
FIG. 5*a* is a schematic diagram when the keycap shown in FIG. 2 is depressed.
Figure 5B:
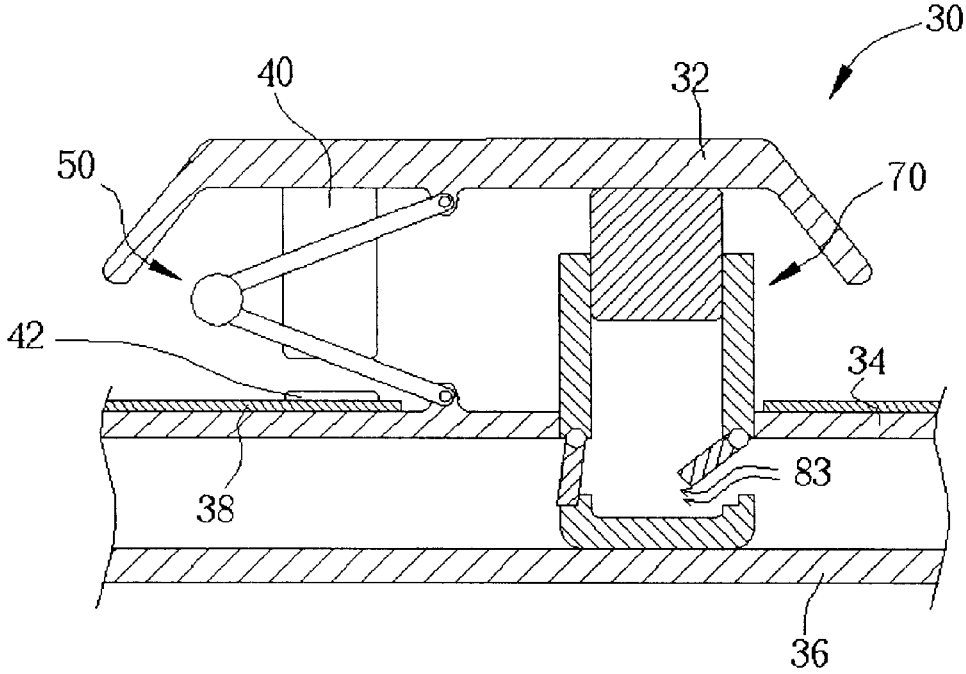
FIG. 5*b* is a schematic diagram when the keycap shown in FIG. 2 is released.

Please refer to FIG. 5*a* and FIG. 5*b*. FIG. 5*a* is a schematic diagram while the keycap 32 shown in FIG. 2 is depressed. FIG. 5*b* is a schematic diagram while the keycap 32 shown in FIG. 2 is released. When the keycap 32 is depressed, the piston 74 fixed on the bottom of the keycap 32 moves downward inside the opening 75 of the container 72 with the keycap 32 to expel air inside the container 72. Because the first door 80 opens toward the outside direction of the container 72 and the second door 82 opens toward the inside direction of the container 72 only, the air inside the container 72 is expelled through the first opening 76, but not through the second opening 78, as an arrow 81 shown in FIG. 5*a*. The elastic component 40 depresses the pressure sensor 42 to generate a corresponding signal simultaneously. On the other hand, when the keycap 32 is released, the connecting device 50 expands, driving the keycap 32 back to the original position and the piston 74, fixed on the bottom of the keycap 32, moves upward inside the opening 75 of the container 72 with the keycap 32 for forming a low pressure area. Because the first door 80 and the second door 82 open toward the single direction of the container 72 only, the air outside the container 72 enters into the container 72 through the second opening 78 barely, but not through the first opening 76, as an arrow 83 shown in FIG. 5*b*. As the keycap 32 rises, the elastic component 40 stops to depress the pressure sensor 42 and no longer generates the corresponding signal. The keycap 32, moving in the up and down manner, causes the air outside the container 72 to enter the container 72 through the second opening 78, and the air inside the container 72 is expelled through the first opening 76.

Figure 6:
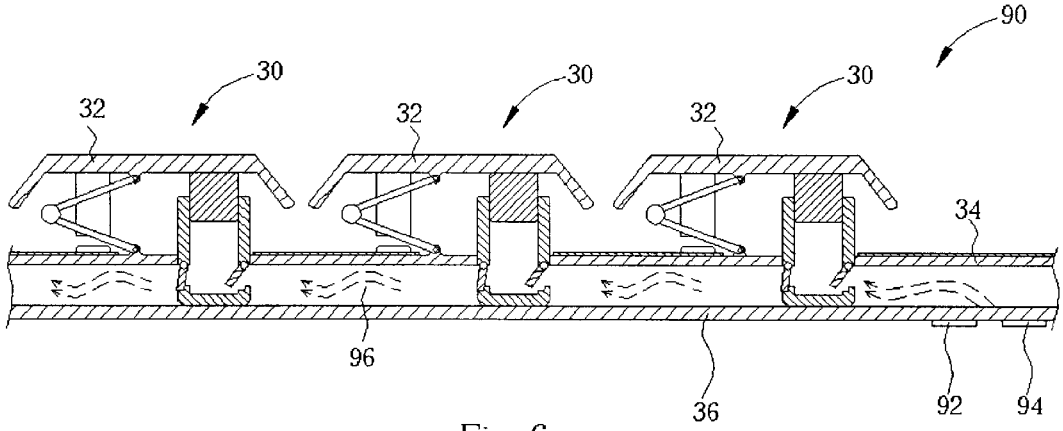
FIG. 6 is a schematic diagram illustrating the heat flowing direction inside a computer keyboard according to the present invention.

Please refer to FIG. 6. FIG. 6 is a schematic diagram illustrating the heat flowing direction inside a computer keyboard 90 according to the present invention. The keyboard 90 includes a processor 92, a chipset 94, and a plurality of key switches 30. The processor 92 and the chipset 94 are located on the bottom of the lower cover 36 of the key switch 30. When the processor 92 and the chipset 94 operate, a great amount of heat is generated so that the air temperature surrounding the processor 92 and the chipset 94 is higher than the air temperature far away from the processor 92 and the chipset 94. Due to the keycap 32 of the key switch 30 moving in an up and down manner causes the air between the upper cover 34 and the lower cover 36 to enter into the container 72 through the second opening 78 of the container 72, and the air inside the container 72 to expel through the first opening 76. Therefore, if adjacent keycaps 32 are depressed respectively, the air between the upper cover 34 and the lower cover 36 is driven in a desired direction, as an arrow 96 shown in FIG. 6. The air with a higher temperature surrounding the processor 92 and the chipset 94 moves to the area with a lower temperature, dissipating the heat generated from the processor 92 and the chipset 94, and no more power is need. When the users use keyboard 90, this heat dissipation functionality is utilized and has great reliability.

Figure 7:
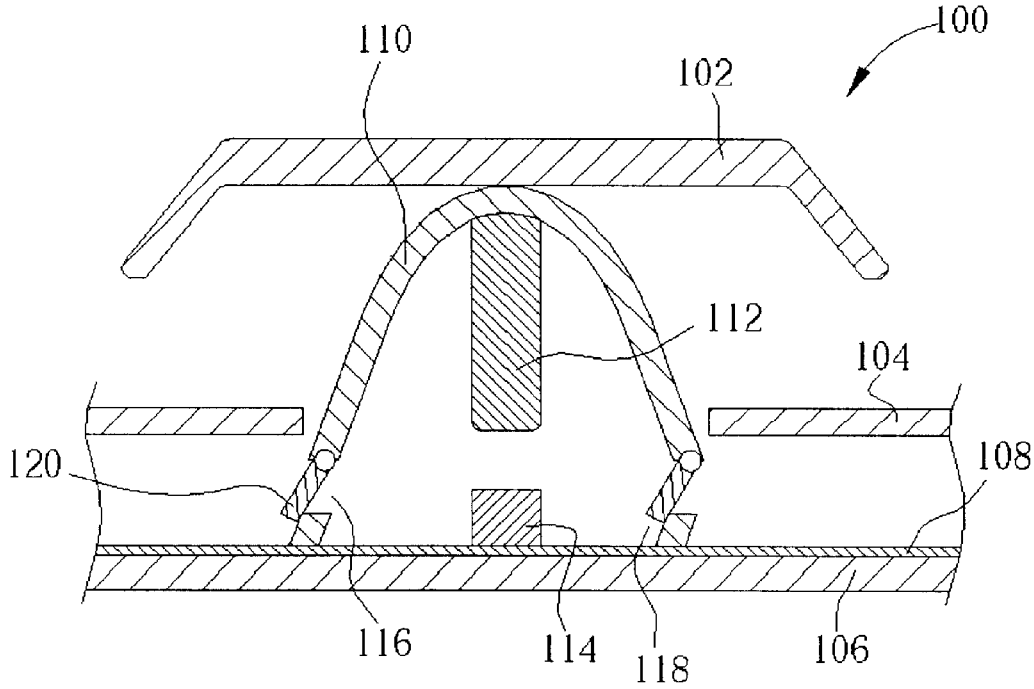
FIG. 7 is a schematic diagram of another key switch according to the present invention.

Please refer to FIG. 7. FIG. 7 is a schematic diagram of another key switch 100 according to the present invention. The key switch 100 includes a keycap 102, an upper cover 104, a lower cover 106, and an elastic film 110. The upper cover 104 is located under the keycap 102. The lower cover 106 is located under the upper cover 104, and a FPCB 108 having a pressure sensor 114 installed thereon is located on the lower cover 106. The elastic film 110 is connected between the keycap 102 and the lower cover 106, and a top of the elastic film 110 is fixed to the bottom of the keycap 102 for mobility in an up and down manner connecting the keycap 102 above the upper cover 104. An elastic component 112 is located on the bottom of the top of the elastic film 110. When the keycap 102 is depressed, the elastic component 112 depresses the pressure sensor 114 of the FPCB 108 to generate corresponding signals. When the keycap 102 is released, the elastic film 110 returns to its original shape, driving the keycap 102 back to an original position.

A sidewall of the elastic film 110 includes a first opening 116, a first door 120, a second opening 118, and a second door 122, all formed between the upper cover 104 and the lower cover 106. An upper side of the first door 120 is hinged pivotally to an upper side of the first opening 116, and is suspended outside the elastic film 110, so that the first door 120 opens toward an outside direction of the elastic film 110 only. Similarly, an upper side of the second door 122 is hinged pivotally to an upper side of the second opening 118, and is suspended inside the elastic film 110, so that the second door 122 opens toward an inside direction of the elastic film 110 only.

Figure 8A:
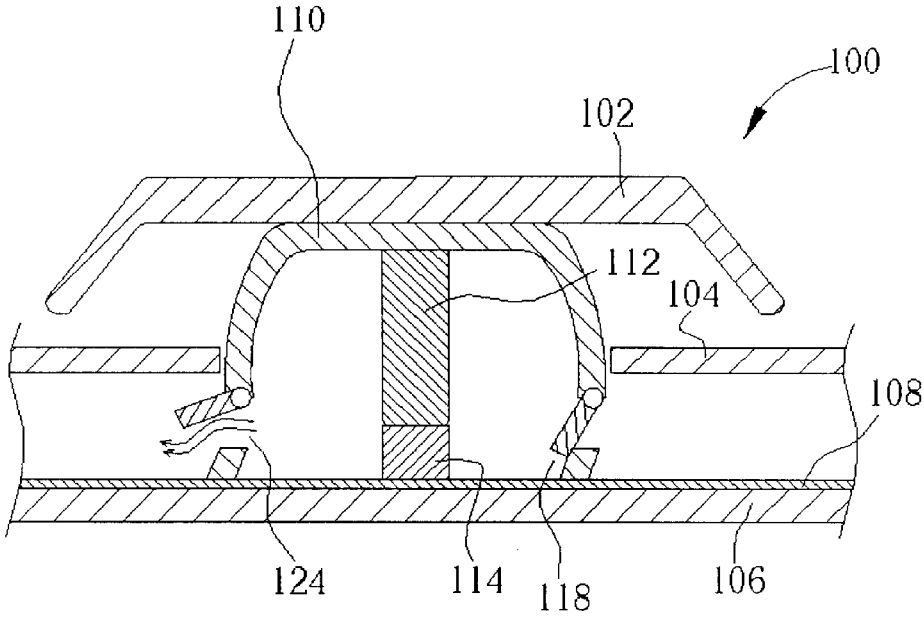
FIG. 8*a* is a schematic diagram when the keycap shown in FIG. 7 is depressed.
Figure 8B:
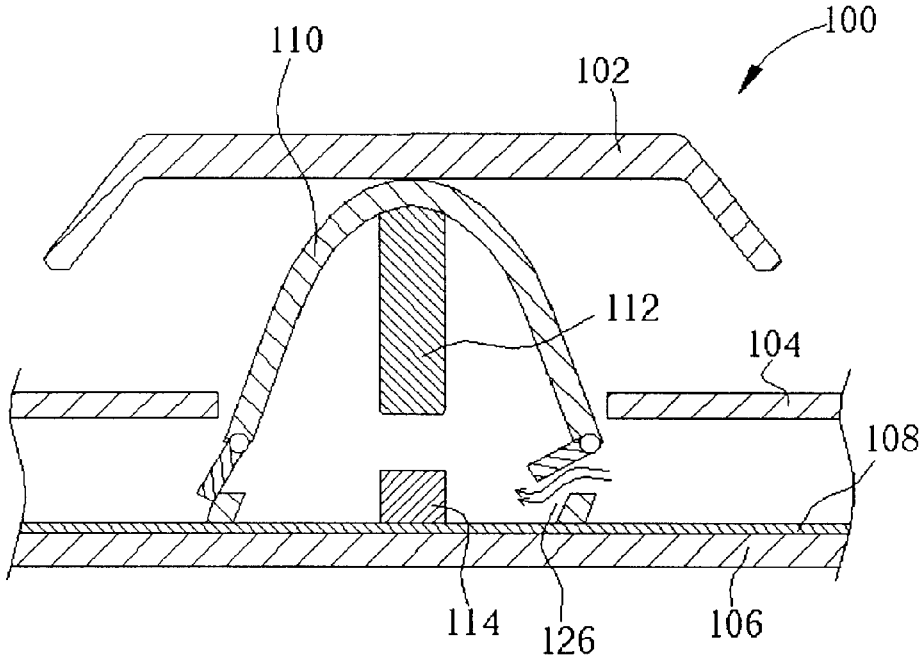
FIG. 8*b* is a schematic diagram when the keycap shown in FIG. 7 is released.

Please refer to FIG. 8*a* and FIG. 8*b* of a keycap 120 according to the second embodiment of the present invention. FIG. 8*a* is a schematic diagram while the keycap 102 shown in FIG. 7 is depressed. FIG. 8*b* is a schematic diagram while the keycap 102 shown in FIG. 7 is released. When the keycap 102 is depressed, the air inside the elastic film 110 is compressed and expelled through the first opening 116, as an arrow 124 shown in FIG. 8*a*, due to the first door 120 and the second door 233 open toward the single direction barely. The elastic component 112 depresses the pressure sensor 114 to generate corresponding signals simultaneously. When the keycap 102 is released, the elastic film 110 snaps back, driving the keycap 102 upward, and drawing the air outside the elastic film 110 into the elastic film 110 through the second opening 118, as an arrow 126 shows in FIG. 8*b*. Therefore, the keycap 102 moving in the up and down manner causes the air outside the elastic film 110 to enter the elastic film 110 through the second opening 118, and the air inside the elastic film 110 is expelled through the first door 120.

When adjacent keycaps 102 are depressed, the air between the upper cover 104 and the lower cover 106 can be driven to move in the desired direction, moving the air in the higher temperature area to the lower temperature area for dissipating the heat.

In the above-mentioned embodiments, the first opening 76, 116 and the second opening 78, 118 are formed on the sidewall of the container 72 and the elastic film 110 respectively. However, the present invention is not limited in this, a plurality of first opening 76, 116 and the second opening 78, 118 can be formed on the sidewall of the container 72 and the elastic film 110, as long as the air can be driven to pass through the openings.

In contrast to the prior art technology, the present invention utilizes the keycap 32, 102 of the key switch 30, 100 moving in the up and down manner to move the air between the upper cover 34, 104 and the lower cover 36, 106. Because the first door 80, 120 and the second door 82, 122 of the key switch 30, 100 open in the single direction, the air in the higher temperature area is driven to the lower temperature area for dissipating the heat. No more power is need, and has a great reliability.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A key switch of a computer keyboard comprising:

a keycap;

an upper cover located under the keycap;

a lower cover located under the upper cover;

a connecting device connected between the keycap and the upper cover for moveably connecting the keycap above the upper cover in an up and down manner; and a heat dissipating device comprising a container and a piston, a top of the piston being fixed on a bottom of the keycap, a bottom of the piston being movably installed inside an opening formed on a top of the container, a bottom of the container being fixed on the lower cover, a sidewall of the container comprising at least a first opening and at least a second opening formed between the upper cover and the lower cover for dissipating heat between the upper cover and the lower cover;

wherein when the keycap is depressed, the piston moves downward with the keycap so as to expel air inside the container through the first opening, and when the keycap is released, the piston moves upward with the keycap so as to allow air outside the container to enter the container through the second opening.

2. The key switch of claim 1 wherein the connecting device comprises:

a first rotational arm with a first edge hinged to a bottom of the keycap;

a second rotational arm with a first edge hinged to a top of the upper cover; and a shaft hinged to a second edge of the first rotational arm and a second edge of the second rotational arm, an elastic component being installed on the shaft;

wherein when the keycap is depressed, the second edge of the first rotational arm and the second edge of the second rotational arm rotate so as to deform the elastic component, and when the keycap is released, the elastic component springs back so as to drive the first rotational arm and the second rotational arm to push the keycap upward.

3. The key switch of claim 2 wherein the elastic component is a spring.

4. The key switch of claim 1 wherein the heat dissipating device further comprises at least a first door and at least a second door, an upper side of the first door being hinged pivotally to an upper side of the first opening, an upper side of the second door being hinged pivotally to an upper side of the second opening, such that when the piston moves downward, the first door opens and air inside the container is expelled through the first opening, and when the piston moves upward, the second door opens and air outside the container enters into the container through the second opening.

5. The key switch of claim 4 wherein the first door is suspended outside the container, and the second door is suspended inside the container.

6. The key switch of claim 1 further comprising a flexible printed circuit board (FPCB) located on the upper cover for generating corresponding signals when depressing the keycap.

7. The key switch of claim 1 wherein the computer keyboard further comprises a processor and a chipset for generating control signals.

* * * * *